United States Patent [19]

Olsen

[11] Patent Number: 4,883,389

[45] Date of Patent: Nov. 28, 1989

[54] METHOD FOR CONSTRUCTING HUGE MODULES, AND A MODULE FABRICATED BY SAID METHOD

[75] Inventor: Torodd E. Olsen, Haugesund, Norway

[73] Assignee: Haugesund Mekaniske Verksted A/S, Haugesund, Norway

[21] Appl. No.: 124,792

[22] PCT Filed: Mar. 6, 1987

[86] PCT No.: PCT/NO87/00017

§ 371 Date: Nov. 2, 1987

§ 102(e) Date: Nov. 2, 1987

[87] PCT Pub. No.: WO87/05349

PCT Pub. Date: Sep. 11, 1987

[30] Foreign Application Priority Data

Mar. 7, 1986 [NO] Norway ..... 860856

[51] Int. Cl.[4] ..... E02B 17/08

[52] U.S. Cl. ..... 405/204; 405/195; 405/203

[58] Field of Search ..... 405/203, 204, 136, 201, 405/195; 52/745

[56] References Cited

U.S. PATENT DOCUMENTS

| | | | |
|---|---|---|---|
| 4,488 | 7/1988 | Rowan | 405/203 X |
| 3,012,406 | 12/1961 | Lassen-Nielsen | 405/136 |
| 3,466,878 | 9/1969 | Esquillan et al. | 405/203 |
| 3,722,169 | 3/1973 | Boehmig | 52/745 |
| 3,927,535 | 12/1975 | Giblon | 405/203 |
| 3,974,618 | 8/1976 | Cortina | 52/745 |
| 4,006,567 | 2/1977 | Flannery | 52/745 X |
| 4,227,831 | 10/1980 | Evans | 405/203 X |
| 4,448,570 | 5/1984 | Berthin | 405/204 |
| 4,493,591 | 1/1985 | Francis, Jr. | 405/203 X |
| 4,636,113 | 1/1987 | Terai | 405/204 X |

FOREIGN PATENT DOCUMENTS

| | | | |
|---|---|---|---|
| 2839666 | 3/1980 | Fed. Rep. of Germany | 405/203 |

*Primary Examiner*—Dennis L. Taylor
*Assistant Examiner*—J. Russell McBee
*Attorney, Agent, or Firm*—Townsend and Townsend

[57] ABSTRACT

A method of constructing and assembling huge modules whose module frame includes sidewalls, a roof, trusswork frames and at least one deck structure secured within and to the module frame involves introducing a separately built deck structure into the module frame at floor level. The introduction is either through a temporary lower opening in a side wall frame, or from beneath the module frame. The deck structure is then positioned within the module frame, controllably elevated therein to a desired level and then secured to the module frame. This sequence is repeated as required such that additional separately built deck structures are similarly introduced into the module frame, positioned, elevated therein and secured thereto. After the desired number of deck structures has been installed, any lower opening in the sidewall frames is closed with trusswork braces.

11 Claims, 10 Drawing Sheets

METHOD FOR CONSTRUCTING HUGE MODULES, AND A MODULE FABRICATED BY SAID METHOD

The present invention relates to a method for constructing and assembling huge modules, and in particular steel trusswork modules for oil rigs operating at sea, and a module fabricated by said method. The completed module is defined by a surrounding module frame comprising truss frames for side walls and a roof, as well as one or more deck structures located within and fixed to the module frame.

In the past, construction of huge steel modules has been limited, inter alia, by technical conditions, as limitations in the lifting capacity in the constructing yards, and limitations in the lifting capacity on crane barges for lifting the completed modules at sea. The typical lifting capacity in larger Norwegian yards is 200–300 tons. Special equipment may, however, be provided for particularly heavy lifting operations, in the form of mobile cranes, floating cranes, or encompassing lifting mast systems. For lifting completed modules at sea, the limitation has been approximately 3000–4000 tons, thus limiting the module weight to approximately 2500–3000 tons.

Thus, constructing modules in the traditional way is limited by the lifting equipment. This, indeed, also goes for the constructing sequence and degree of completion of prefabricated deck structures and module members.

The modules have huge dimensions, and may have a width of more than 20 meters, and a length of 50 meters or more. Previously, module weights have not exceeded 2500 tons.

The constructing technique commonly used has been some kind of prefabrication of trusswork structures in the form of truss frames. Initially, such a frame is erected and constitutes a central vertical frame in the completed module. A lower deck half is then mounted onto the central frame, and a second deck half is mounted onto the other side of the central frame. Thereafter, auxiliary supports are erected at each corner of the lower deck, and one or more auxiliary supports are erected as well between each corner to support the next deck half which is, in turn, mounted onto the central frame. A corresponding deck half is mounted onto the other side of the central frame. Another set of auxiliary supports is erected and placed on the latter deck, whereafter another deck half is provided on the supports and is fixed to the central frame. In this manner, the module is assembled until the predetermined number of deck structures has been mounted. Finally, the prefabricated truss structures that will form side walls are erected and secured to the deck edges, and the auxiliary supports can be removed. Thus, the completed module is comprised of trusswork frames in the side walls and the central wall, and any desired number of deck structures. Installation of equipment, including pipeworks and cableworks may be carried out during deck construction.

The developing trend seems to be that lifting capacity at sea will increase to approximately 12000 tons. This is reflected by the interest of oil companies in constructing larger and more complete modules on shore, which will provide time savings, weight savings, and be less expensive. There is reason to believe that module weights of future oil rigs will be between 4000 and 10000 tons.

There exists a demand from oil companies for constantly decreasing total project time. This means a reduced period of time from the decision that an oil field is to be developed until production is a fact. There is also a need to reduce the steel weights on the rings, i.e. a desire for low specific weight of the modules. Furthermore, a high degree of prefabrication on shore would be advantageous, i.e. low requirement for completion at sea. All demands are based on the desire for reduced developing costs.

As to the demands of the companies, the desire to be competitive as regards prices, i.e. high productivity, is decisive. There is a demand for good utilization of the production facilities, i.e. for short throughput at the yard, and optimal utilization of equipment and staff. Furthermore, it is desireable to find a design and constructing methods furthering production.

Those constructing techniques conventionally employed cannot fully utilize the possibilities of savings in construction time and the improvements of productivity which are present when dimensions and weights are no longer limited.

According to the present invention, time savings is achieved compared with conventional constructing methods due to the fact that all deck structures may be erected simultaneously, and simultaneously with the construction of the module frame, and because equipment can be installed on the deck structures before the latter are introduced into the module. In addition, time savings are achieved due to the fact that dates for ordering equipment for decks are less critical, since equipment with long delivery periodes may enter into the building process at later dates than conventional. This savings is further emphasized by the fact that the uppermost deck, which is the first to be installed, normally has the least complicated equipment with the shortest period for delivery, whereas the lowermost deck has equipment conventionally requiring long delivery periods. It is also possible to save time by having the deck structures or portions thereof built by subcontractors to a high degree of completion. Consequently, the constructing yard will experience more flexibility in managing staff and equipment. Additionally, time savings are achieved by an essential increase in productivity as a consequence of having decks manufactured and equipment installed on ground. There will be far more convenient access with cranes, simplified transport of equipment, reduced demands for temporary platforms and scaffolding, and a considerably larger working area will be accessible, so that a larger total labor force can be put on the project.

A construction period for a module of 20–22 months is not unusual, and it is considered possible to save 6–8 months of the construction time relative to the previous constructing method. Improvements of productivity are not included in this assessment.

As regards saving weights, the present method will normally not have a weight saving effect per se, but indirectly, weights per unit of volume of the module will be reduced, because it is possible to build modules efficiently with a very large volume. Indirectly, the number and size of modules will also influence the total weight of the rig.

With the present method it will be easier to achieve a higher degree of completion. Again, this is partly a consequence of the assembling procedure and partly a consequence of the module size which permits more work to be done and tested within the systems of the module. Connections with other modules are considerably reduced, and thus the demand for completion at sea is reduced. This is substantially reflected by reduction of costs and time savings.

The above mentioned is achieved according to the invention by a method of the kind set forth in the introduction. According to the invention, a first, separately built, deck structure is introduced at floor level into the module frame through a temporary lower opening in one of the side wall frames. This deck structure is properly positioned inside the module frame, and is then controllably elevated inside the module frame to the desired level and then fixed to the module frame. This sequence is, if desired, repeated for a second separately built deck structure to be introduced into said module frame, positioned, and elevated to a desired level below the first deck structure, and then fixed to the module frame. This sequence is repeated until the desired number of deck structures is installed, and the lower opening in the side wall frame(s) is then closed by insertion of truss braces. It will also be possible to construct the module frame excluding the opening, i.e. with all side walls being closed. The frame is then elevated to a suitable level above floor level to permit the deck structure to be introduced from underneath the module frame before being elevated inside the frame.

Advantageously, two or more cross beams may temporarily be provided and secured on top of the module frame, and hoisting means including wires provided on said cross beams, with the wire ends fastened to a temporary lifting frame located at floor level inside said module frame, for elevating or lifting the deck structure to the desired level.

Alternatively, said deck structure may be elevated in the module frame by means of hydraulic jacks provided at floor level, or by lifting mast structures or the like provided external of the module frame.

The module frame may be assembled by erecting the side wall frames and securing them in pairs at their adjacent ends to make said adjacent ends form corners. A roof frame is provided on top of the upper end rim of the side wall frames, and secured to the side wall frames in order to form a ridge defined module frame.

The module frame is adapted to be enlarged without serious problems by providing the module frame with one or more approximately vertical inner frames. These frames define two or more smaller module frames with adjacent or common partitions (inner frames) having mutually equal or different dimensions separate deck structures may be inserted independently into each new module frame, each separate deck structure being elevated to a level independently of the deck levels in the adjacent module frame(s).

Advantageously the deck structures may be constructed simultaneously, and be partially or completely provided with equipment and components before being inserted into the module frame.

The deck structures can be conveyed from the constructing site to and into the module frame(s) by means of rigid, removable transport frames running on rails, said frames being adapted to the opening in the module frame.

The fixing or attachment between separate members of the module frame and between decks and the module frame is preferably achieved by welding, but other connections, e.g. bolted or riveted unions, are feasible.

According to the invention, the above described methods result in a module characterized by a module frame comprising side wall frames and a roof frame, and one or more deck structures provided inside said module frame at desired levels, with said deck structure(s) secured to said module frame such that together they form a reinforced integrated truss module.

Lifting gears particularly suited for usage with the invention include linear winches such as those produced by Freyssinet (Centre Hole Jacks) having a lifting capacity of up to 930 tons per unit.

Decks weighing 7000 tons may be lifted with existing equipment using up to 6 or 8 such lifting units. Decks weighing between 800 and 2000 tons are most common today.

Applicant is unaware of significant limitations for the present method. The present method is not limited by the strength of the frame of the module, which is constructed to absorb such loads statically and dynamically with safety factors added.

Other and further objects, features, and advantages will appear from the following description of a preferred embodiment of the invention, with reference to the enclosed drawings, where FIGS. 1–6 diagrammatically present the constructing steps for constructing huge trusswork modules according to the present invention;

FIG. 7 presents the separate members necessary for constructing the module frame;

FIG. 8 presents the module frames with hoisting gears and lifting frames, as well as rails for displacement of the module; and FIG. 9 is a sectional view through the module of FIG. 8, where a removable transport frame running on rails is diagrammatically shown.

FIGS. 1–6 diagrammatically present the separate constructing steps of a method for constructing and assembling huge modules (1), especially trusswork modules of steel for oil rigs operating at sea. Construction may, advantageously, occur in a constructing hall or, alternatively, outdoors. In the figures the deck structures 3 are presented in the form of exposed frames in order to illustrate the constructing method. However, during constructing operations, the deck structures will be completely or partially provided with equipment, including pipeworks and cableworks, which conventionally belong to the module.

Figure 1:
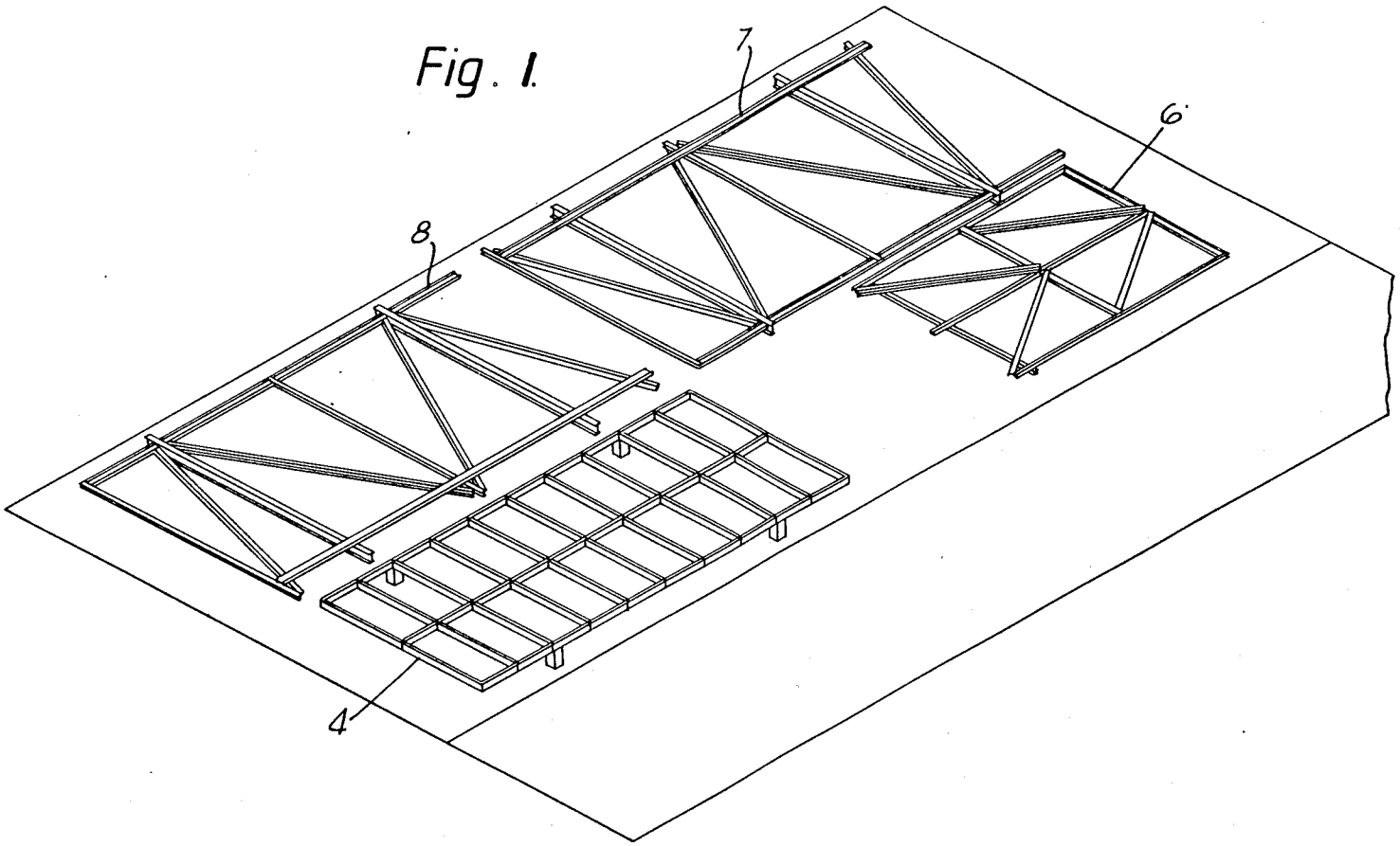

FIG. 1 presents separate module frame members, e.g. side walls 6, 7, 8, and a roof frame 4 located on a yard floor in an assembly plant. When the module frame 2 is to be constructed, the side walls 6, 7, 8 are erected and secured to each other's adjacent end portions, said portions thus forming corners. In the figure, two longitudinal walls 7, 8, and an end wall 6 are shown, but all side walls may, naturally, be of equal length thus forming a square base. It is, of course, also feasible that one or a number of the side walls will have a more irregular shape than the plane side wall frames shown.

Figure 2:
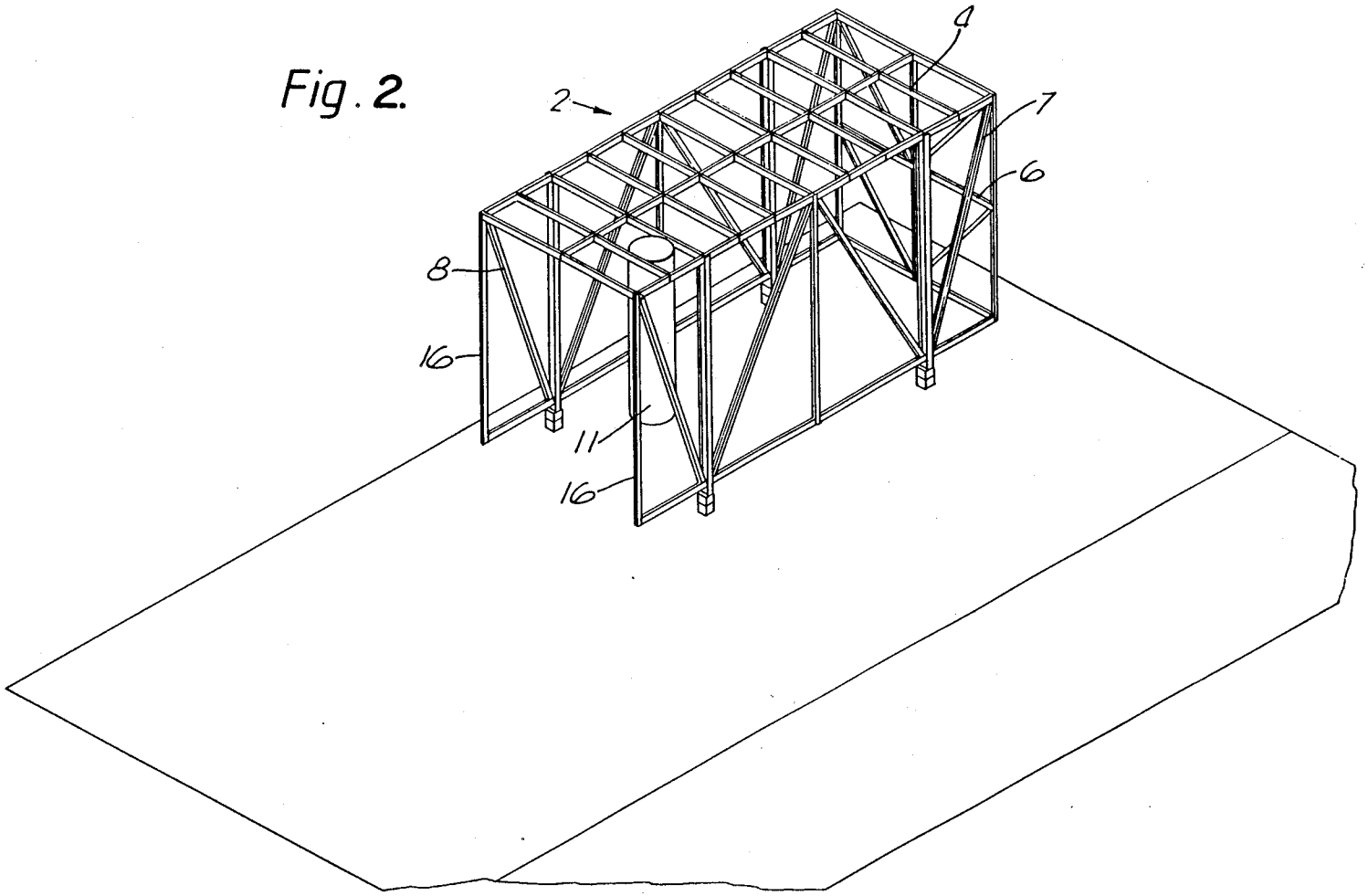

FIG. 2 presents the assembled module frame 2 without front side wall 5. The roof frame 4 is provided on top of the end portions of side wall frames 6, 7, 8 and is secured to the frames. Process equipment 11 has an extension which, in the completed module, will extend through several deck structures 3 and be mounted to roof 4 of module frame 2 before the first deck is introduced.

Figure 3:
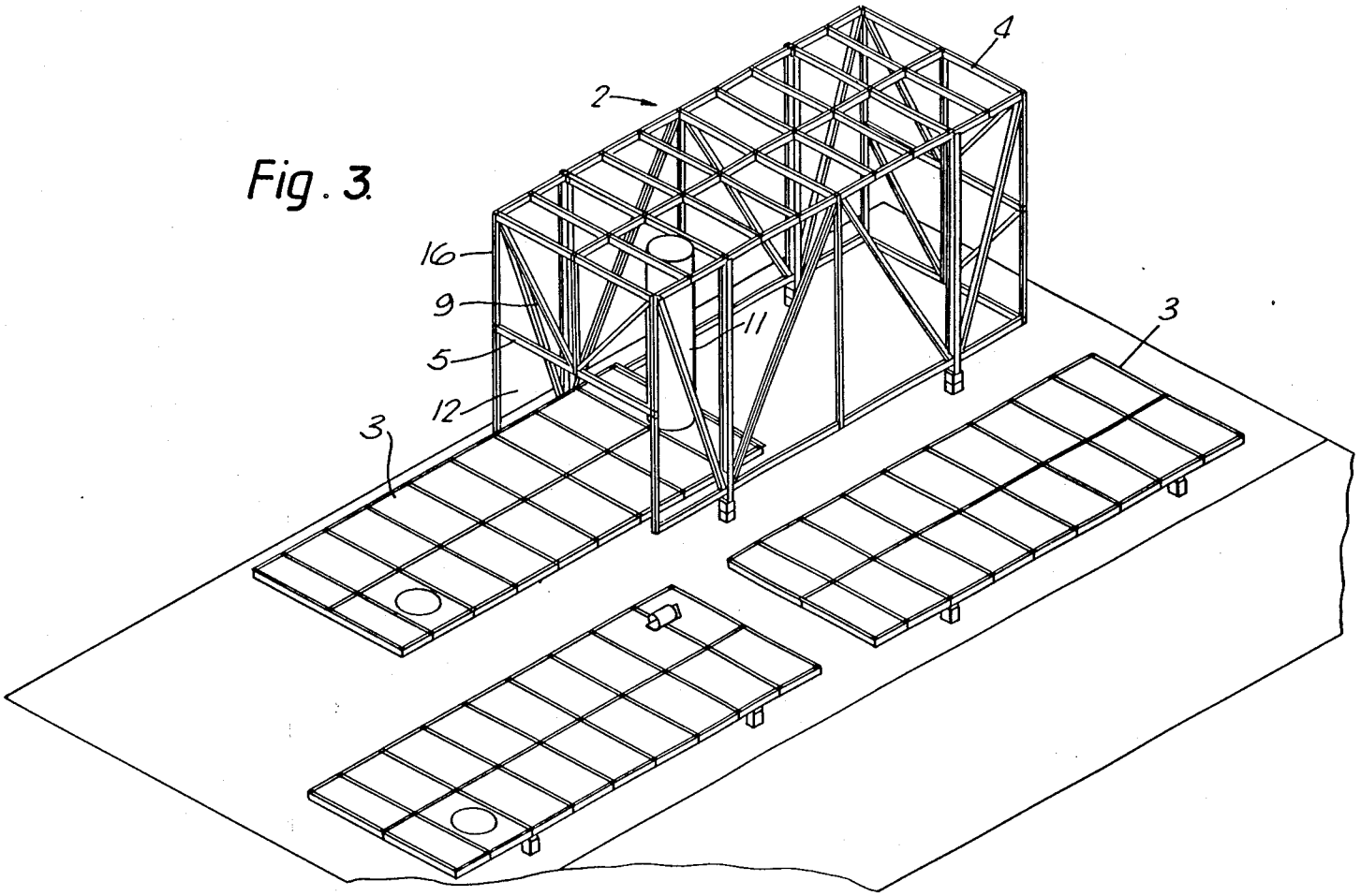
Figure 4:
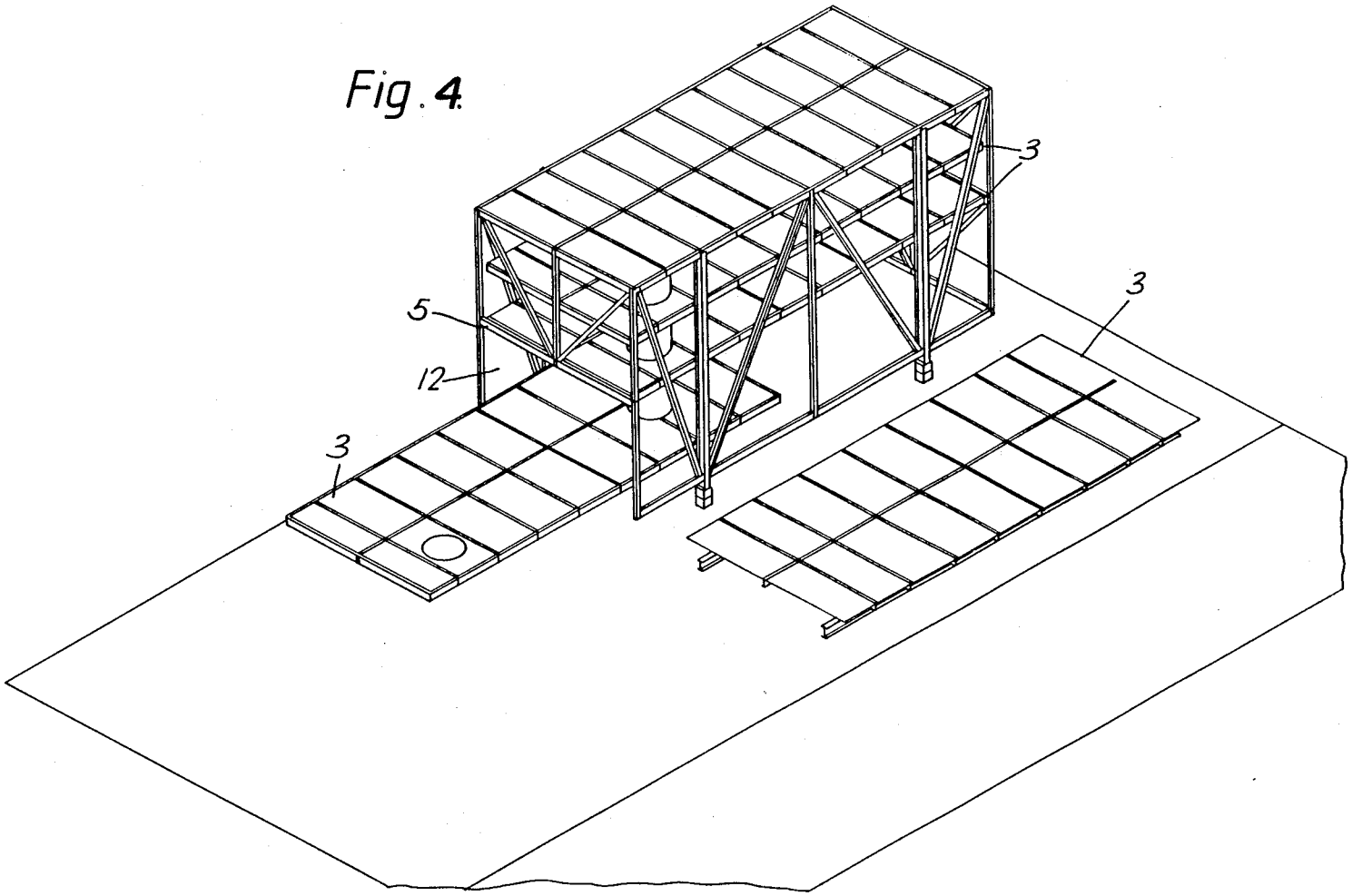

In FIG. 3 truss braces 9 are shown, secured to vertical members 16 of side wall frames 7, 8 and to roof frame 4 to form end wall 5 with an opening 12. This figure shows the step in which a first deck structure 3 is introduced into the module frame 2. Two further deck structures ready for installation are also shown. Deck structure 3 is then moved completely inside the module frame 2 it is properly positioned relative to the module frame 2 and relative to the process equipment 11, and is elevated inside the module frame to a desired level. FIG. 4 shows a first and a second deck structure 3 secured to the module frame 2, and a third deck structure is shown being moved into the module frame.

Figure 5:
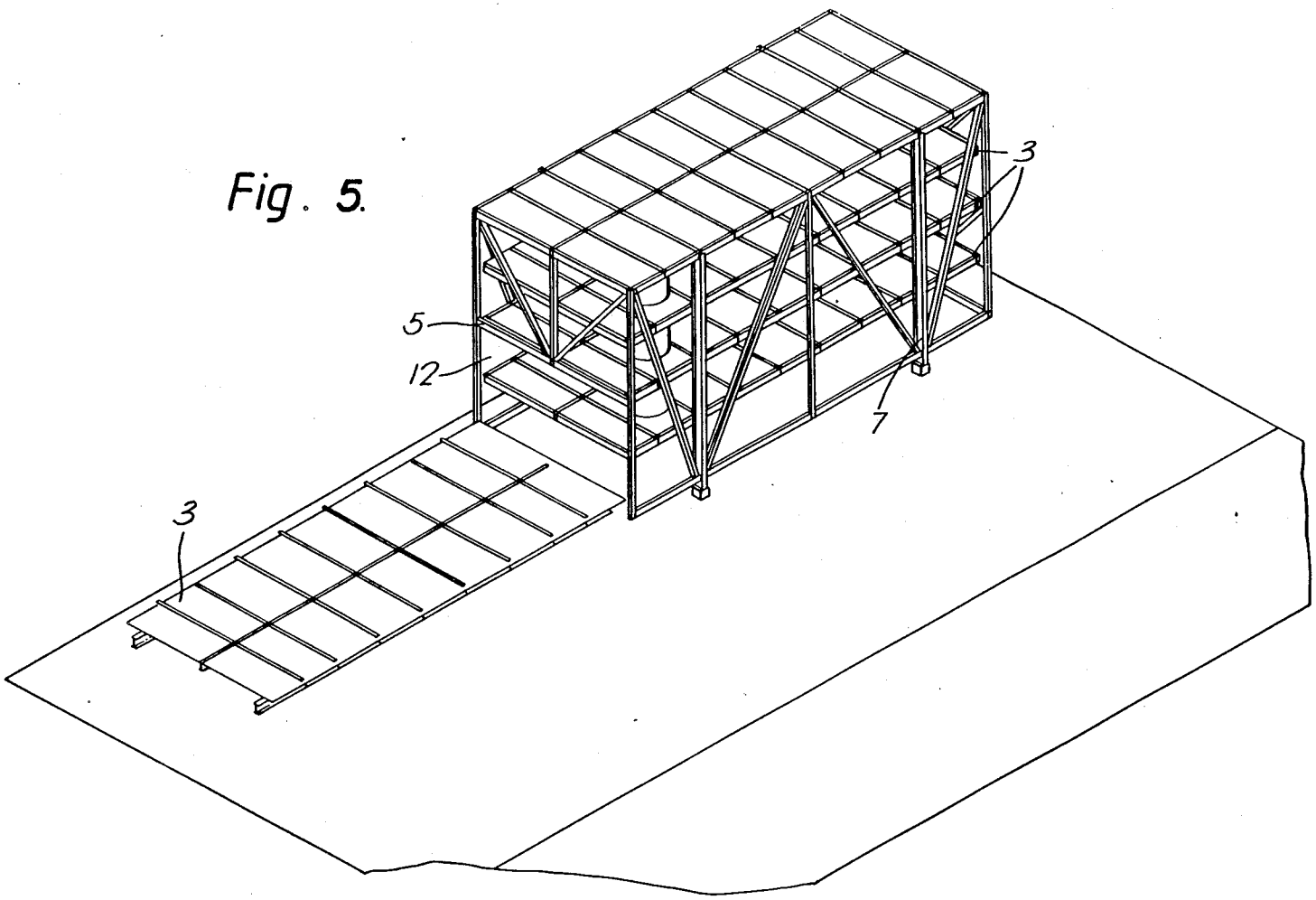

FIG. 5 presents the last deck structure 3 ready to be introduced in the module frame.

Figure 6:
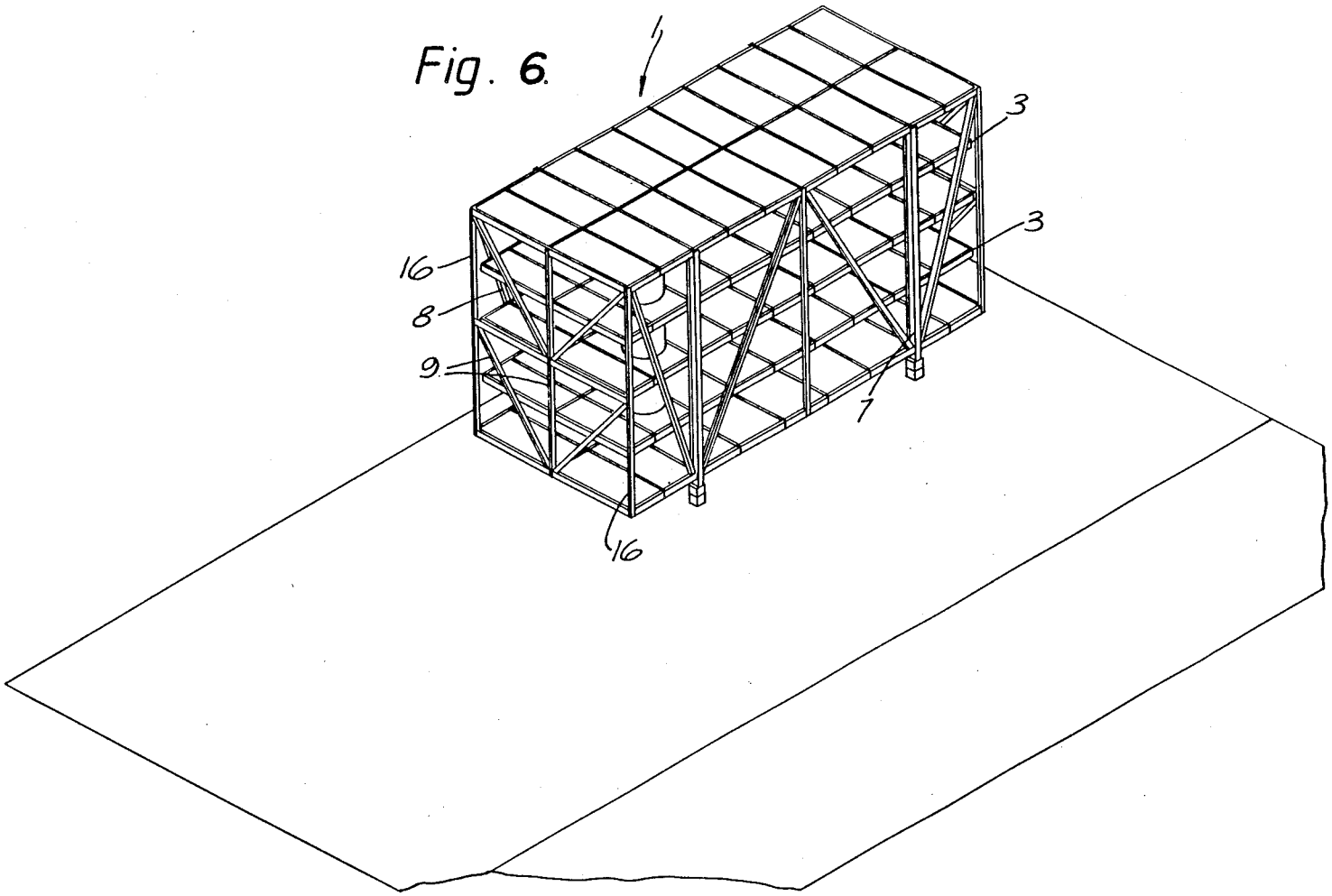

FIG. 6 presents the module 1 constructed and assembled, and with the last truss braces 9 secured to the vertical end members 16 of the side wall frame and to deck structures 3. Thus the end wall 5 forms an end wall similar to the end wall 6.

Figure 7:
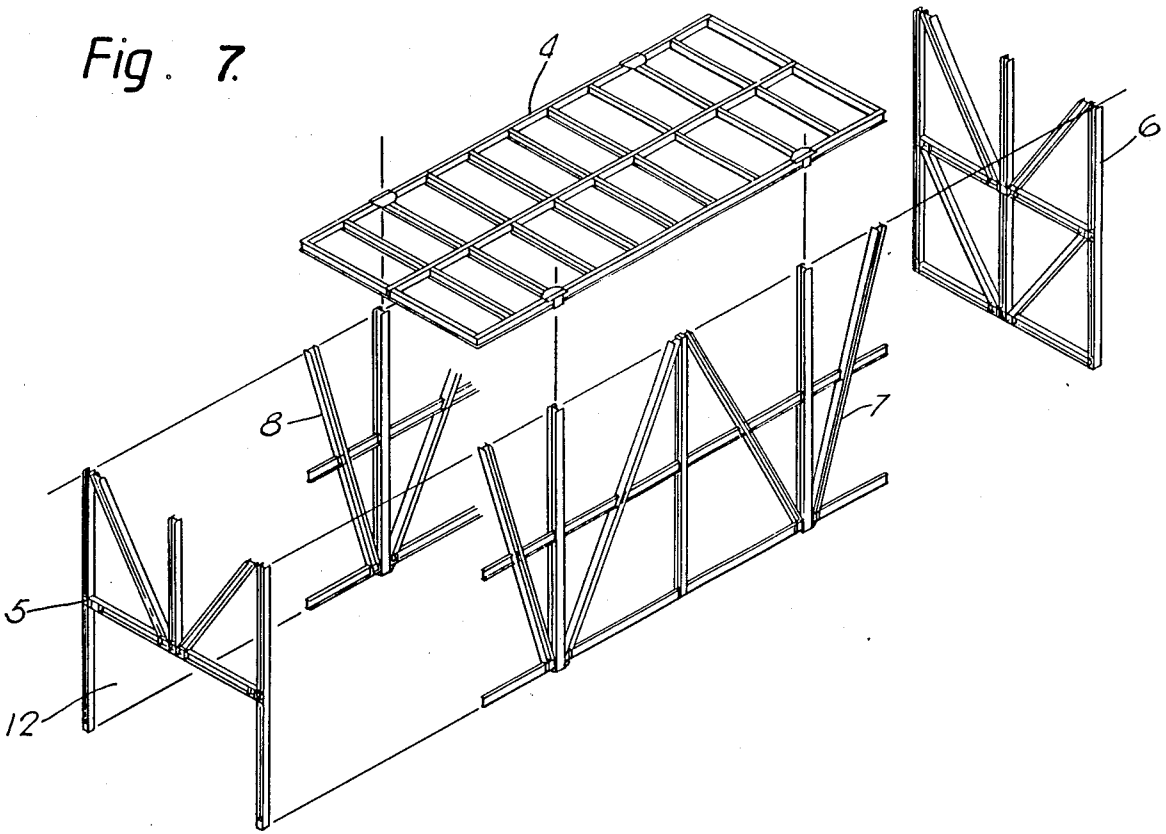

FIG. 7 presents another constructing procedure differing from that shown in FIGS. 1–6. Two of the side walls lack their vertical end member, and the module frame 2 is built by erecting side walls 5, 6 and 7, 8 in pairs, after which they are fixed together in pairs adjacent end portions, said portions forming corners. Then roof frame 4 is mounted, as disclosed above, on top of the end surfaces of the side wall frames 5, 6, 7, 8. There is still a lower opening 12 in one side wall frame 5 for inserting deck structures 3.

Figure 10:
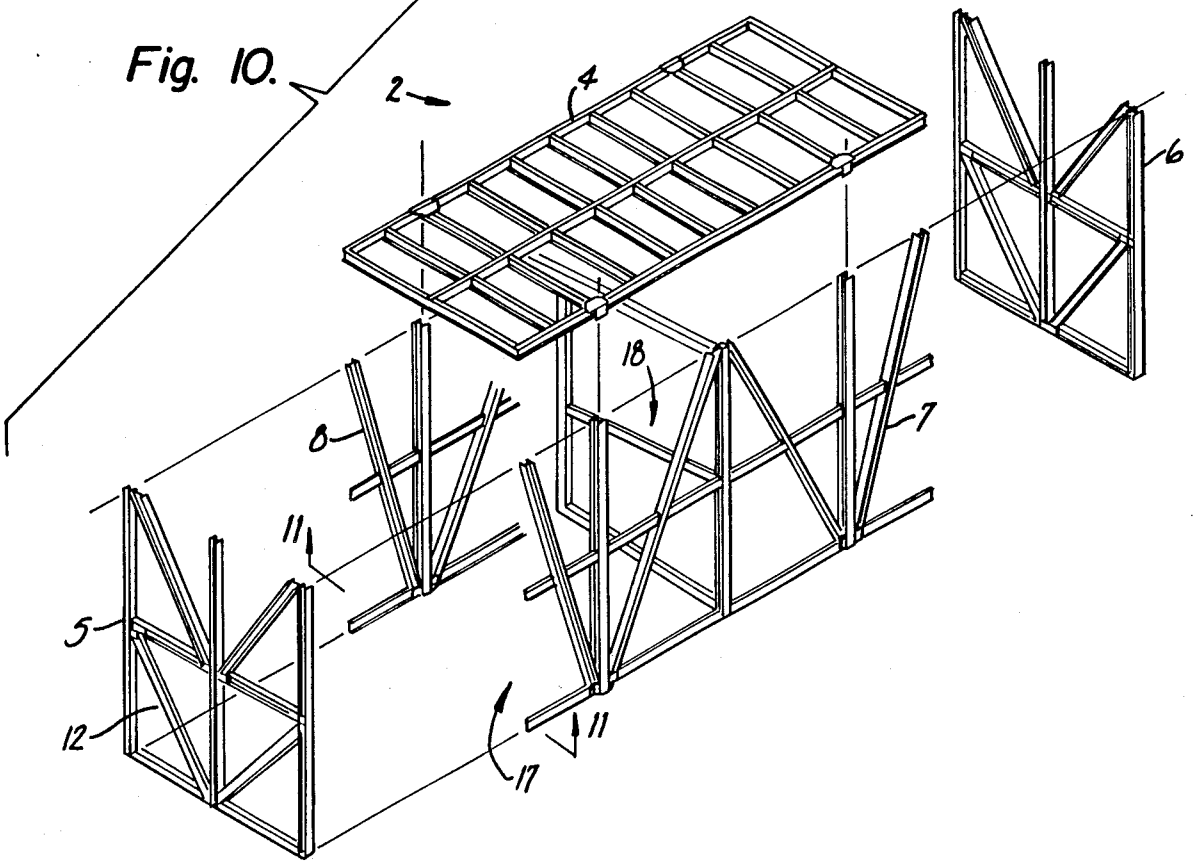
FIG. 10 is an embodiment depicting several members necessary for constructing a module frame having no openings in the widewalls, and including a dividing partition.
Figure 11:
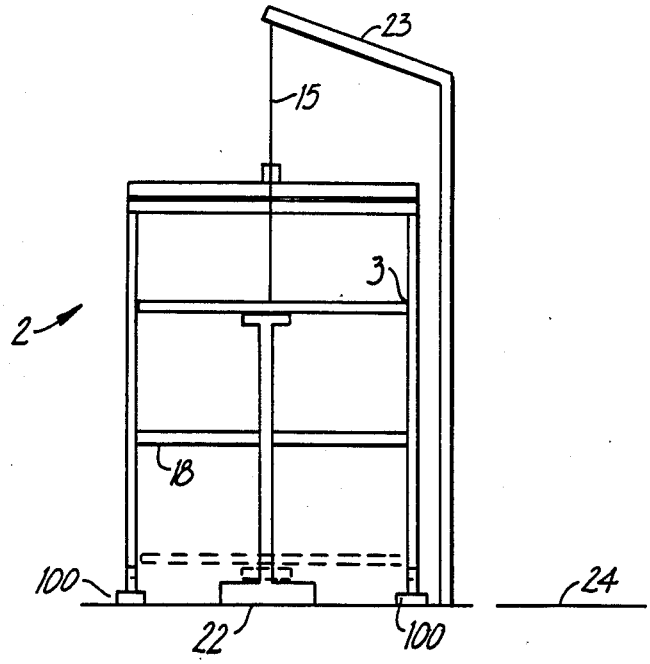
FIG. 11 is a diagrammatical section of the module of FIG. 10 along section 16—16, showing a hydraulic jack or a lifting mast for raising a deck structure within the module.

FIG. 10 shows a module frame 2 having no openings in a sidewall, but providing an open bottom 17 through which deck structures 3 may be lifted from floor level. FIG. 10 includes a dividing partition, shown generally as 18 which divides module frame 2 into compartments, either of which may receive decks 3. It is understood that a dividing partition 18 may also be included in the module frame 2 depicted in FIG. 7, and that partition 18 may be configured other than as shown in FIG. 10. FIG. 11 is a diagrammatical section through the module frame 2 along section 16—16 according to FIG. 10, showing a hydraulic jack 22 or a preferably guyed lifting mast 23 for raising a deck structure 3 from floor level 24 into the partition between sidewall 5 and partition 18 of module frame 2 through open bottom 17. Hydraulic jack 22 or lifting mast 23 are equally applicable where there is no partition 18 present in module frame 2. Module frame 2 is shown elevated from ground 24 by supporting foundations 100.

Figure 8:
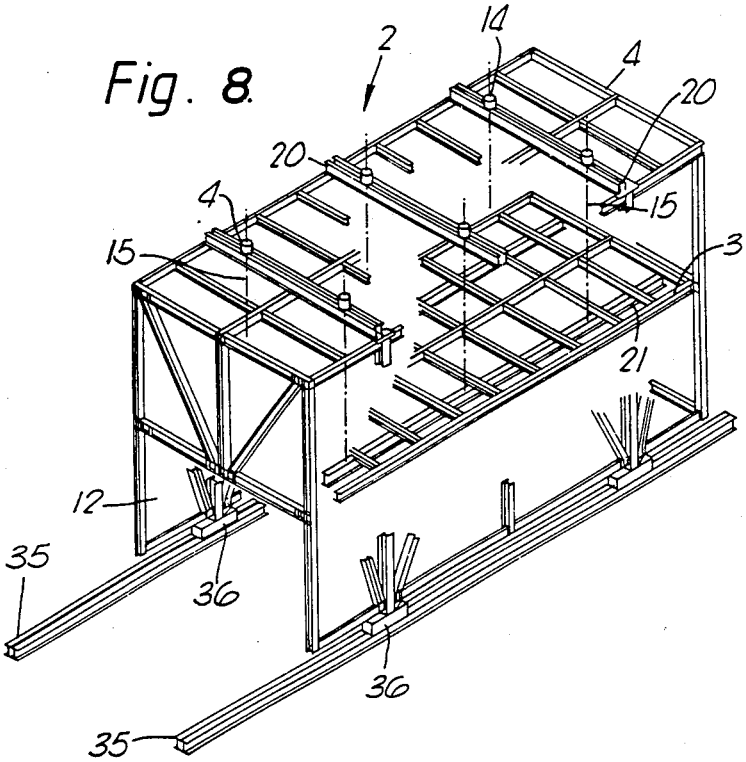

FIG. 8 presents the module frame 2 provided with wheel sets 36 for movement along rails 35. Cross beams 20 are temporarily provided on top of the module frame 2, and to said cross beam hoisting equipment 14, e.g. linear winches, is secured. From the hoisting equipment, wires 15 are suspended and are fastened to a lifting beam or a lifting frame 21 at their lower ends. In the figure a deck structure 3 is shown being lifted by means of the hoisting equipment to a predetermined level. When the desired number of deck structures is secured said cross beams 20, the hoisting equipment 14, and the lifting frame 21 are removed. Truss braces 9 are provided in the opening 12 and are secured to the deck structure and side wall 5 to close the opening 12 and to provide additional stiffening of the module.

Figure 9:
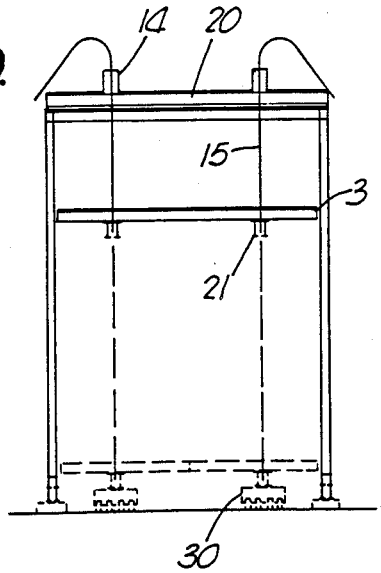

FIG. 9 is a diagrammatical section through the module frame 2 according to FIG. 8 showing lifting operations of a deck structure 3. In addition to hoisting equipment 14, and cross beam 20, rigid and removable transport beams, if desired, transport frames 30 running on wheels are illustrated for conveying the deck structures 3 from the building site and into the module frame.

As disclosed above, the method comprises a constructing sequence permitting maximum completion of decks and intermediate-decks of the module before they are installed in the module frame 2. All decks are built at floor level or on supports at a low level, and are completely or partly equipped with associated equipment. Simultaneously to building the decks, the module frame is completed, apart from the lower opening 12 for later insertion of the deck structures.

Using hoisting equipment in the form of linear winches, the transmission of loads to the deck is achieved by means of wires, cables, rods, or chains, in addition to the lifting frame or lifting beams which are located underneath the deck structures to be lifted in order to distribute the load. The forces from the hoisting equipment are absorbed by the module frame.

Another lifting procedure lifts from the underside of the deck with a jacking up operation. Jacking up may be carried out in different manners by transmitting load to the module frame or by transmitting load to the floor level on which the module rests. Hydraulical or mechanical jacks may be used.

Yet another lifting method comprises lifting by means of masts or lifting mast structures that are provided external or internal of the module frame and serve as transmission means for the lifting forces. Lifting may be carried out by means of winches, hydraulics or mechanically.

I claim:

1. A method for constructing and assembling huge modules (1), particularly trusswork modules of steel for oil rigs operating at sea, wherein the completed module is defined by a surrounding module frame (2) comprising trusswork frames for side walls (5,6,7,8) and roof (4), and at least one deck structure (3) provided therein and secured to said module frame (2), characterized in that a first separately built deck structure (3) is introduced at floor level into said module frame (2), either through a temporary lower opening (12) in one of the side wall frames, or from below into a module frame lifted from floor level, and is properly positioned inside said module frame (2), and is then controllably elevated in said module frame (2) to a desired level, whereafter said deck structure (3) is secured to said module frame (2), and that this sequence is, if desired, repeated so that a second separately built deck structure is similarly introduced into said module frame (2), is properly positioned and elevated to a desired level underneath said first deck structure, and is then secured to said module frame, said sequence being repeated until the desired number of deck structures is installed, and that any lower opening (12) in said side wall frame(s) is then closed by providing trusswork braces (9).

2. A method as defined in claim 1, characterized in that two or more cross beams (20) are temporarily provided and secured on top of said module frame (2), and that hoisting means (14) with wires (15) are provided on said cross beams (20), and that the wire ends are secured to a temporary lifting frame (21) at floor level and provided internal of said module frame (2), whereafter the deck structure (3) is elevated to a desired level.

3. A method as defined in claim 1, characterized in that deck structure (3) is elevated internal of said module frame (2) by means of hydraulic jacks provided at floor level, or by lifting mast structures or the like, such means being provided external of said module frame.

4. A method as defined in claim 1, characterized in that said module frame (2) is assembled by erecting side wall frames (5,6,7,8), said frames being mutually secured at adjacent end portions, said portions forming corners, and that a roof frame (4) is then provided on top of an upper end rim of the side wall frames and is secured to said side wall frames in order to form a rigid, defined module frame.

5. A method as defined in claim 4, characterized in that the module frame (2) is enlarged and provided with at least one substantially vertical inner frame thus defining at least two smaller module frames with adjacent or common partitions, said module frames having mutually equal or different dimensions, and that separate deck structures are installed independently into each new module frame, as each deck structure may be elevated to a level independent of the deck levels in the adjacent module frame(s).

6. A method as defined in claim 1, characterized in that the deck structures are assembled simultaneously and that equipment and components are completely or partly mounted on them before said deck structure(s) is/are inserted into said module frame (2).

7. A method as defined in claim 1, characterized in that said deck structures are transported from the building site to and into said module frame(s) (2) by means of rigid and removable transport frames (30) running on wheels and adapted to the opening in module frame (2).

8. A method as defined in claim 1, characterized in that a fixing or securing is achieved by welding and/or bolted or riveted unions.

9. A module produced by the method defined in claim 1, characterized in a module frame (2) comprising side wall frames (5,6,7,8) and a roof frame (4), and at least one deck structure (3) provided inside said module frame at desired levels, where the deck structure(s) is/are secured to said module frame (2) in such manner that they together form a reinforced, integrated trusswork module (1).

10. A module as defined in claim 9, characterized in that said module has longitudinal walls (7,8) and end walls (5,6), and that said temporary lower opening is provided in one end wall (5) of said module frame (2).

11. A module as defined in claim 9, characterized in that a larger module frame (2) furthermore comprises at least one substantially vertical inner frame and, thus, defines two or more smaller module frames having common or adjacent partitions (inner frames) and being mutually equal or different as regards dimensions, and that separate deck structures are provided internal of and secured to said module frames at a level independent of the deck levels in the adjacent module frame(s).

* * * * *